US005664907A

United States Patent [19]

Betsinger

[11] Patent Number: 5,664,907

[45] Date of Patent: Sep. 9, 1997

[54] APPARATUS AND METHOD FOR REMOVING AND PULVERIZING STEEL REINFORCED PAVEMENT

[76] Inventor: Thomas R. Betsinger, 1213 Meadow La., Onalaska, Wis. 54650

[21] Appl. No.: 497,286

[22] Filed: Jun. 30, 1995

[51] Int. Cl.[6] ..... E01C 23/12

[52] U.S. Cl. ..... 404/90; 241/101.742; 299/36.1

[58] Field of Search ..... 404/90, 91, 101, 404/118, 104; 299/36.1, 37.3, 37.5; 241/101.742, 101.763

[56] References Cited

U.S. PATENT DOCUMENTS

| | | | |
|---|---|---|---|
| 2,768,794 | 10/1956 | Putnam | 299/36.1 X |
| 3,732,623 | 5/1973 | Rank et al. | 404/90 |
| 3,843,274 | 10/1974 | Gutman et al. | 404/91 |
| 3,952,811 | 4/1976 | Carre | 404/90 X |
| 4,043,601 | 8/1977 | Schiller | 299/36 |
| 4,309,126 | 1/1982 | Pfaff | 404/90 |
| 4,560,207 | 12/1985 | Eftefield et al. | 299/36.1 X |
| 4,676,688 | 6/1987 | Caradot | 404/91 |
| 4,793,730 | 12/1988 | Butch | 404/91 X |
| 4,929,120 | 5/1990 | Wiley et al. | 404/77 |
| 4,946,307 | 8/1990 | Jakob | 404/91 X |
| 5,026,205 | 6/1991 | Gorski et al. | 404/91 X |
| 5,028,170 | 7/1991 | Gorski et al. | 404/90 X |
| 5,078,540 | 1/1992 | Jakob et al. | 404/90 |
| 5,315,770 | 5/1994 | Campbell | 37/96 |
| 5,441,361 | 8/1995 | Campbell | 404/90 |

OTHER PUBLICATIONS

Universal Hammermills Scrap Processing Equipment; Form No. 124–7593, Universal Engineering Corp.

*Primary Examiner*—James Lisehora
*Attorney, Agent, or Firm*—Robert J. Harter

[57] ABSTRACT

A self-propelled pavement remover removes and pulverizes concrete reinforced with steel rod. The machine drives a wedge under the pavement to lift it up and feed it into a hammer mill. The hammer mill pulverizes both the concrete and steel rod into a compact aggregate which is then windrowed along the roadway for enhanced base course or conveyed to dump trucks. The aggregate is then readily hauled away more efficiently than if it were left as large, irregular slabs of concrete.

13 Claims, 7 Drawing Sheets

APPARATUS AND METHOD FOR REMOVING AND PULVERIZING STEEL REINFORCED PAVEMENT

BACKGROUND OF THE INVENTION

1. Field of the Invention

The subject invention generally pertains to pavement removers and more specifically to one that removes and pulverizes steel reinforced pavement.

2. Description of Related Art

U.S. Pat. No. 4,309,126 describes pavement remover that breaks up concrete under compression, but provides no means for breaking up and disposing of the steel reinforcing rod. U.S. Pat. No. 3,732,623 is for an asphalt recycler that employs a paddle wheel for breaking up and mixing used asphalt. Current pavement processors fall short in completely removing and pulverizing steel reinforced concrete pavement.

SUMMARY OF THE INVENTION

To overcome the shortcomings of current processors it is an object of the invention to pulverize a combination of concrete and steel reinforcing rod.

Another object is to permanently remove both old concrete and old reinforcing rod from a road without returning either to the same road which is about to be resurfaced with new materials.

Another object is to convey the resulting aggregate in a direction opposite to that which the pavement remover is traveling.

Another object is to break reinforced concrete in shear.

Another object is to incorporate a conveyor having an aggregate inlet at a relatively low elevation and situated between a front and rear set of drive wheels.

Another object is to use two conveyors in series flow relationship to change the direction of aggregate flow.

Another object is to split the frame of the pavement remover lengthwise to facilitate highway transport between job sites.

These and other objects of the invention are provided by a novel pavement remover having means for lifting concrete reinforced with steel rod while pulverizing both materials with swinging hammers attached to a main rotor.

DESCRIPTION OF THE PREFERRED EMBODIMENT

Basic Structure

Figure 1:
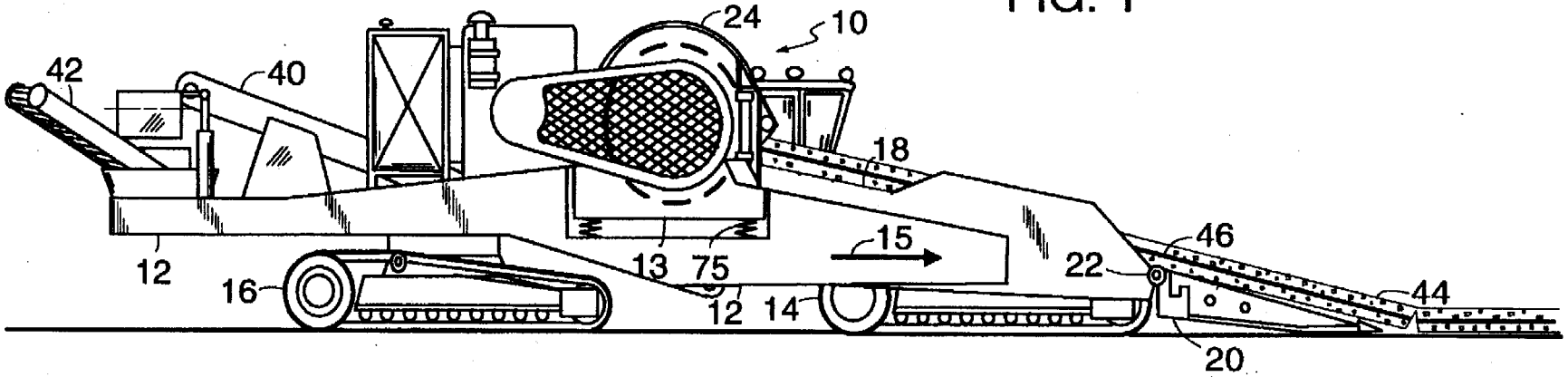
FIG. 1 is aside view of One embodiment of the invention.
Figure 2:
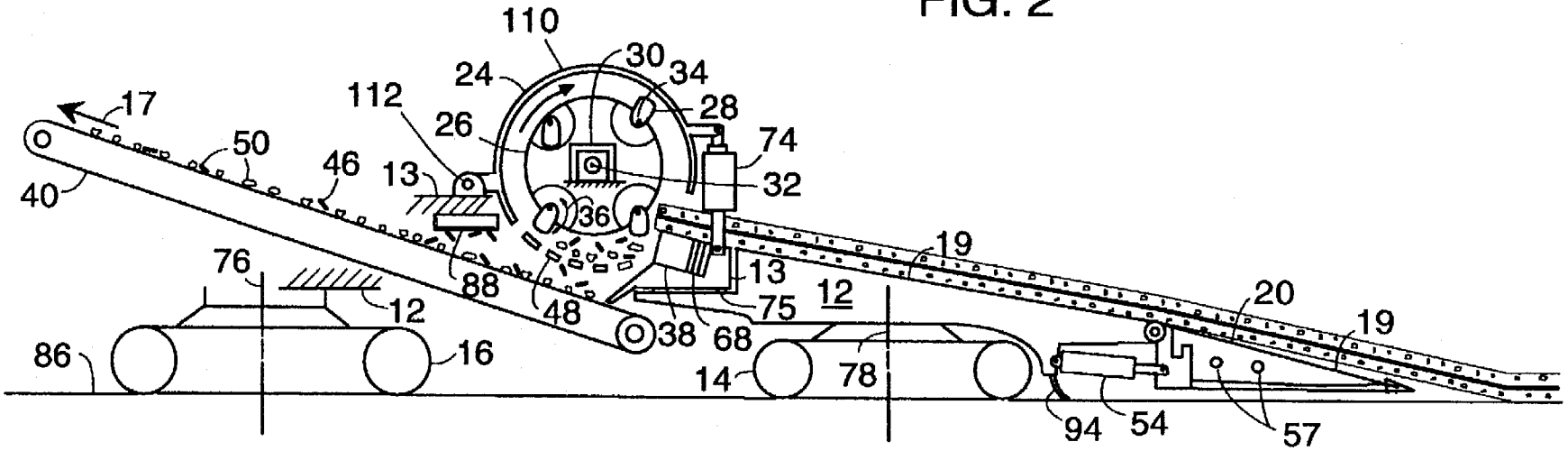
FIG. 2 is a schematic cross-sectional side view of another embodiment of the invention.

A pavement remover 10 shown in FIGS. 1 and 2 includes a first frame 12 mounted to a front drive track 14 and a rear drive track 16. Frame 12 includes a ramp 18 onto which a wedge 20 is pivotally mounted at point 22. A hammer mill 24 is mounted to a secondary frame 13 near the upper end of ramp 18.

Referring to FIG. 2, hammer mill 24 comprises a rotor 26 having several hammers 28. Rotor 26 is mounted to frame 13 by way of a bearing block 30 and is rotatable about a longitudinal centerline 32 of shaft 33. Each hammer 28 is further rotatable about its own pivot point 34. This enables each hammer to swing 360 degrees (as indicated by arrow 36) toward and away from longitudinal centerline 32 to void jamming or breakage of hammers 28.

A four-edged indexable anvil 38 is attached to frame 13 at a location slightly spaced apart from hammer mill 24. To minimize vibration transmission, frame 13 is resiliently connected to frame 12 by way of vibration isolating mounts 75. Mounts 75 represent any means of isolating vibration including, but not limited to, springs, rubber and telescoping shock absorbers.

Pavement remover 10 also includes a first conveyor 40 and a second conveyor 42 mounted toward the rear of frame 12.

An engine powered prime mover 43 is the power source for pavement remover 10. The power is delivered to the various components by conventional means well known to those skilled in the art.

Basic Operation

Drive tracks 14 and 16 force wedge 20 underneath pavement 44 which is to be removed and pulverized along with its steel reinforcing rod 46. As pavement remover 10 drives forward, (as indicated by arrow 15) pavement 44 slides upward over ramp 18. Pavement 44 extends over anvil 38 where it is sheared and pulverized by hammers 28. When the broken pieces of pavement 44 and reinforcing rod 46 are small enough to pass through screen 48, the pavement aggregate 50 is carried away by first conveyor 40 and delivered to second conveyor 42. Second conveyor 42 discharges aggregate 50 to a dump truck to be hauled away.

Additional Features Of The Invention

Figure 3:
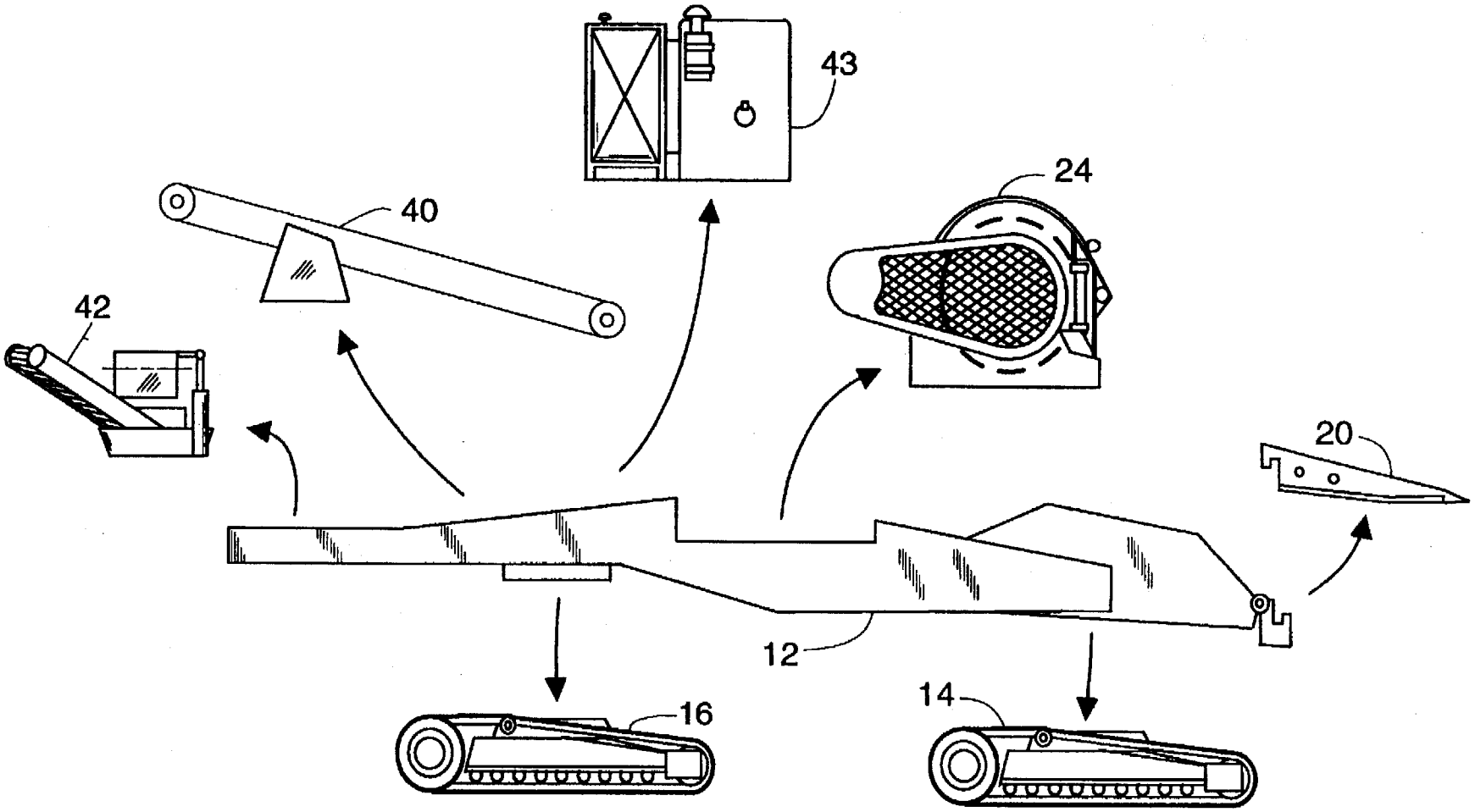
FIG. 3 shows the modular disassembly of one embodiment of the invention.
Figure 4:
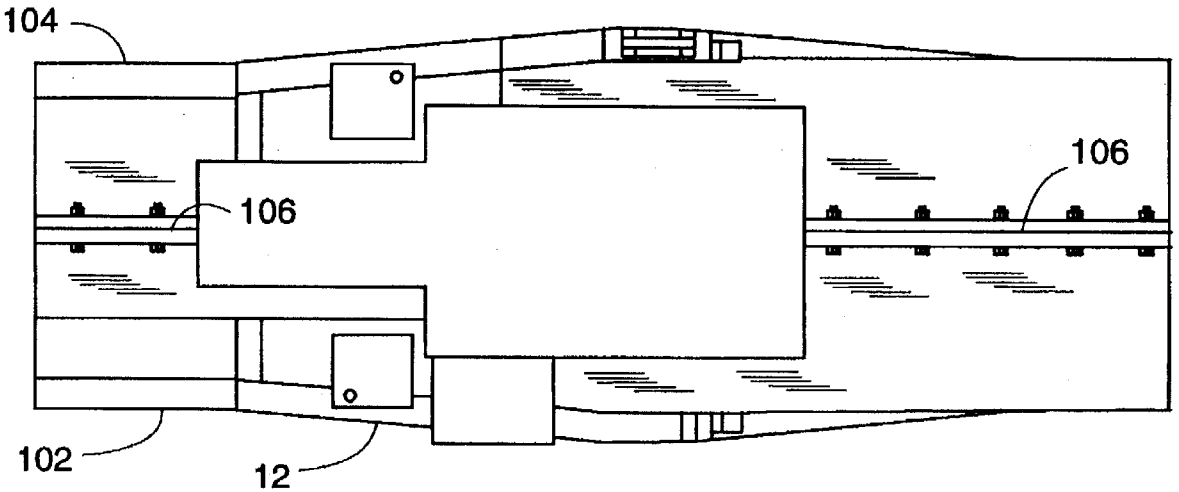
FIG. 4 is a top view showing how the frame of the pavement remover is split lengthwise.
Figure 5:
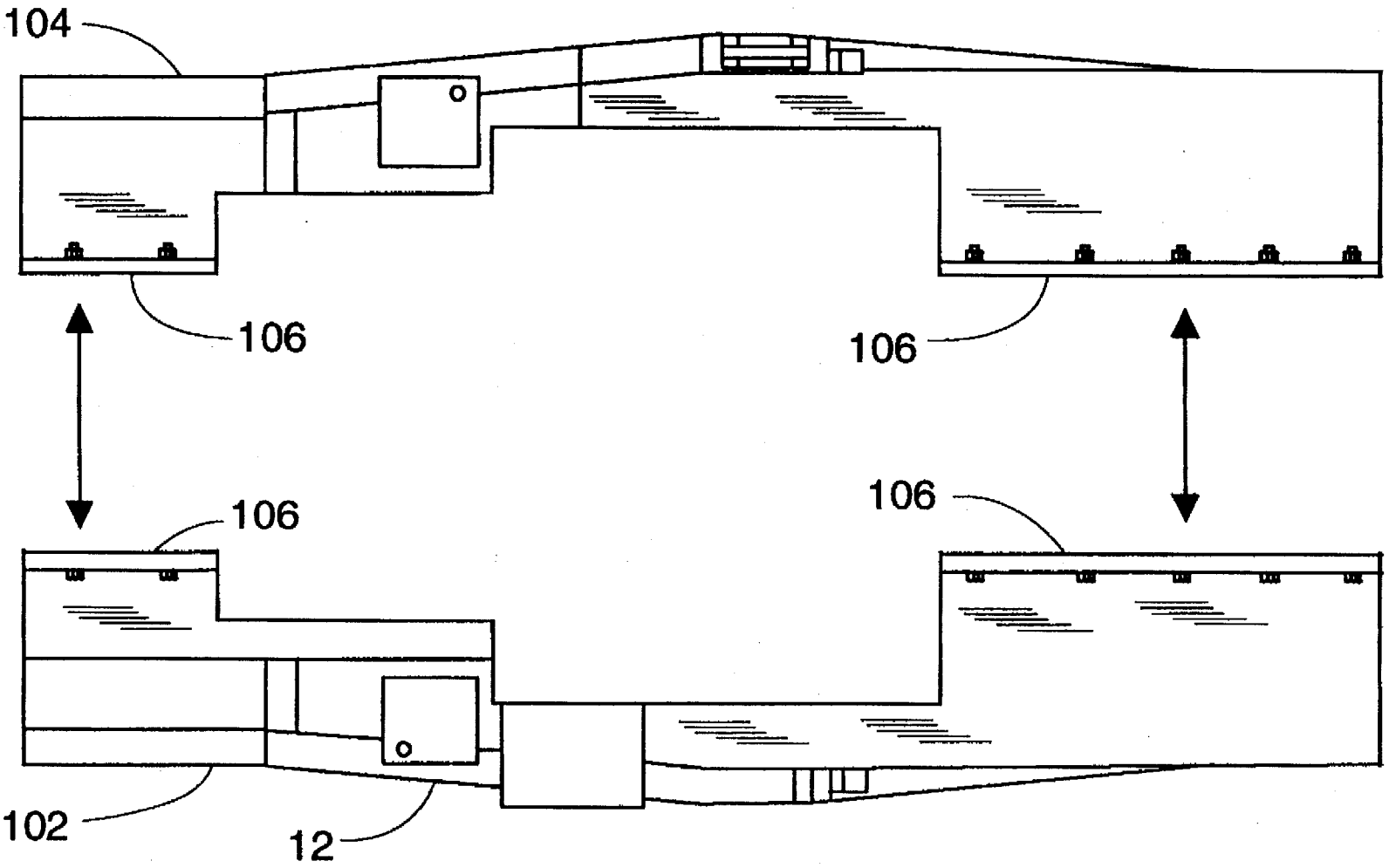
FIG. 5 is another top view showing how the frame is split lengthwise.

FIGS. 3, 4 and 5 show the modular construction of pavement remover 10 and how it is broken down and separated. This facilitates hauling pavement remover 10 along highways having width restrictions. Referring to FIG. 3, the removable component parts of pavement remover 10 included hammer mill 24, prime mover 43, first conveyor 40, second conveyor 42, front drive track 14, rear drive track 16, wedge 20, and frame 12.

Frame 12 is further separable lengthwise into a right half frame 102 (viewing in-the direction of arrow 15 of FIG. 1) and a left half frame 104. Frames 102 and 104 are bolted together at joint 106. The width of frames 102 and 104 do not exceed 8.6 feet, while their combined width, i.e., the width of frame 12 exceeds 8.6 feet.

Figure 7:
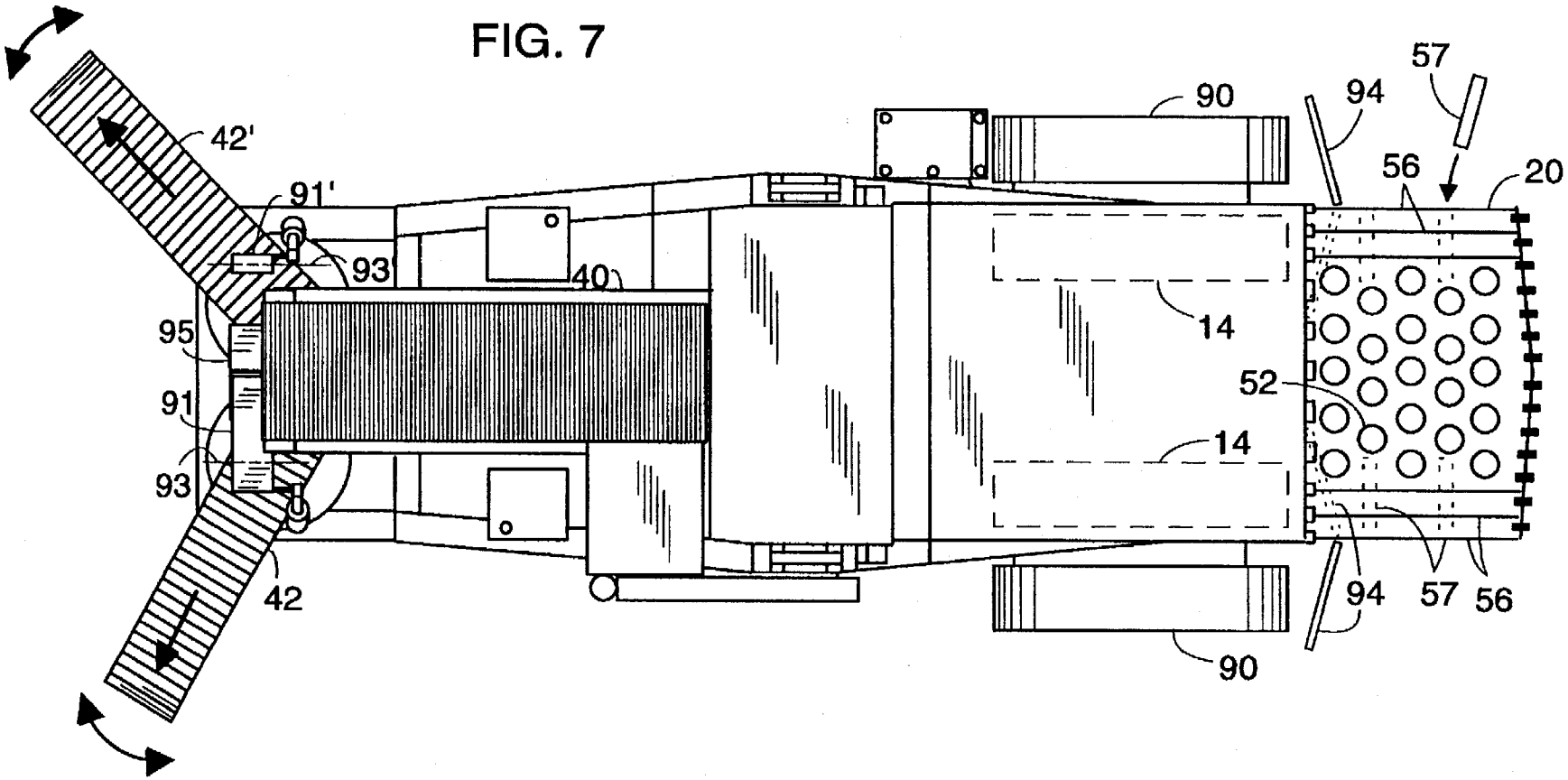
FIG. 7 is a top view of another embodiment of the invention.

Wedge 20 and ramp 18 constitute an incline 19. Incline 19 has holes 52 through which dirt can fall through while pavement 44 passes over the top. The pivotal adjustment of wedge 20 is accomplished by hydraulic cylinder 54. Wedge 20 includes side segments 56 that are removable so that the width of wedge 20 matches the width of the road. FIG. 7 shows how segments 56 are removable and how they are locked in place by pins 57.

Pavement remover 10 is steerable by rotating rear drive track 16 (first set of drive tracks) about a substantially vertical axis 76. In one embodiment of the invention, front drive track 14 is also rotatable about a second substantially vertical axis 78.

Figure 6:
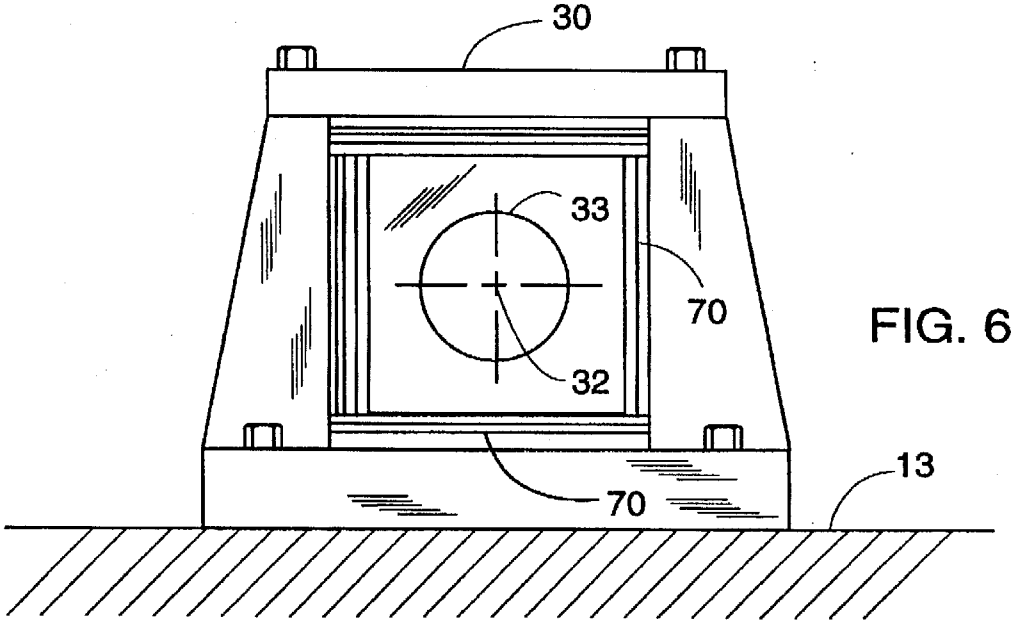
FIG. 6 is a schematic top view of the rotor bearing block of FIG. 5.

Referring to FIG. 2, the position of rotor 26 relative anvil 38 is adjustable by adding or removing shims 68 next to anvil 38. Further adjustment is possible by rearranging shims 70 within bearing block 30 as shown in FIG. 6.

Referring back to FIG. 2, hammer mill hood 110 is pivoted backward about point 112 by cylinder 74 to provide maintenance access to rotor 26.

Figure 8:
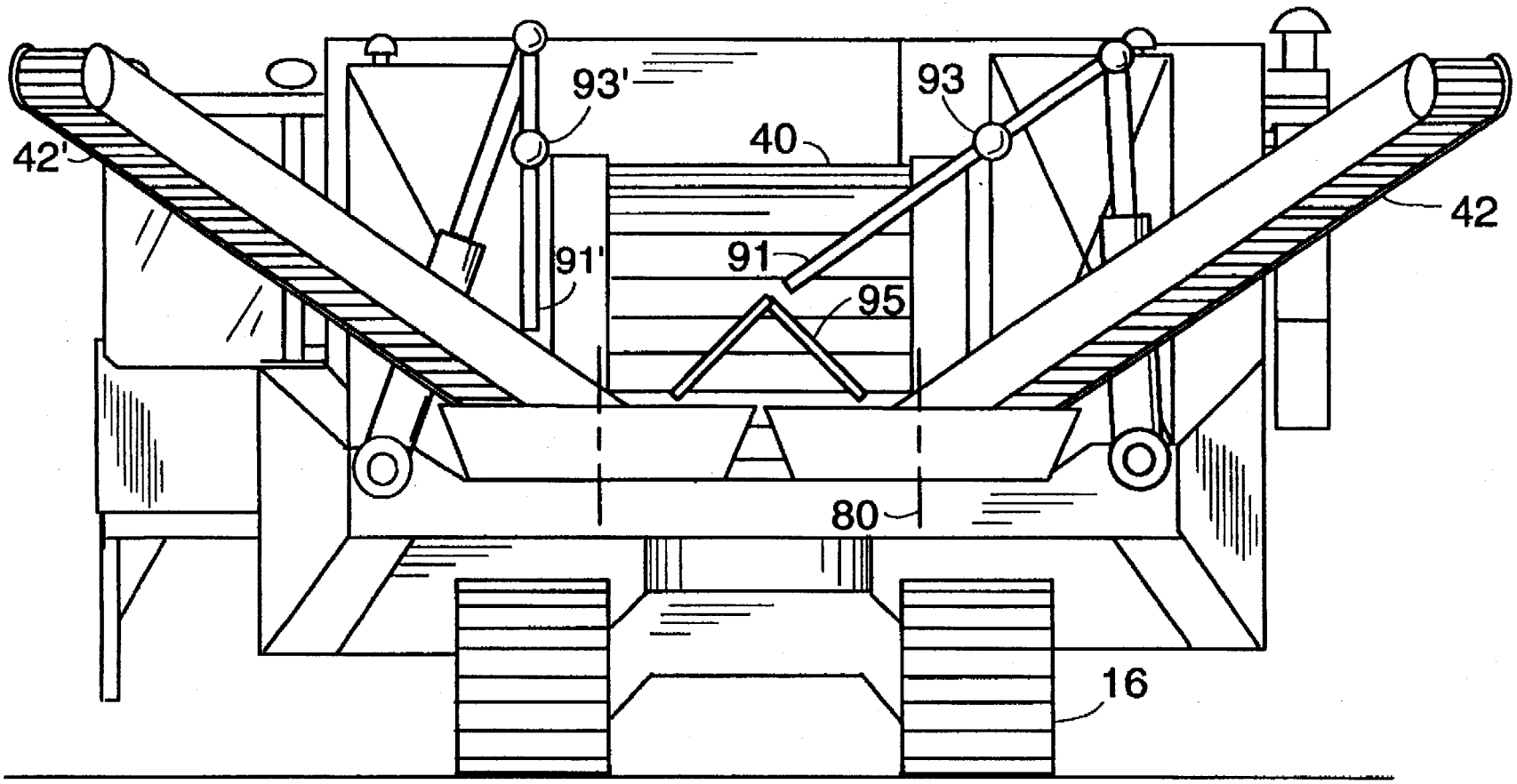
FIG. 8 is a rear view of the invention.

Referring to FIGS. 1, 7 and 8, second conveyor 42 is pivotally mounted about axis 80 for various discharge directions. Aggregate 59 discharged from conveyor 40 is selectively directed to conveyors 42 and/or 42'. This is done by hydraulic actuated panels 91 and 91' that pivot about points 93 and 93'. An inverted V-panel 95 helps guide the flow of aggregate 50.

In addition, a magnetic conveyor represented by item 88 of FIG. 2 can be positioned adjacent aggregate 50 to magnetically separate out broken pieces of rod 46.

For effective operation, the road travel speed (first speed) of pavement remover 10 is balanced in relation to the rotational speed of rotor 26. In one embodiment of the invention, the ground speed (travel speed relative to ground 86 and represented by arrow 15) is 20 to 40 feet per minute while the rotational speed 15 of rotor 26 is 300 to 500 revolutions per minute. This provides a ground speed to drum rpm ratio that falls within an optimum range of 0.25 to 2 in/rev. It has been determined that effective material flow occurs when conveyor 40 conveys aggregate 50 at an absolute speed (relative to wedge 20) that is greater than the road travel speed (absolute value) of pavement remover 10. The speed (relative to wedge 20) of aggregate 50 along conveyor 40 is indicated by arrow 17 of FIG. 2.

For loosely packed soil, a third set of drive tracks 90 can be used. Also, a plow 94 can be used to clear the ground surface for drive tracks 14 and 16.

Although the invention is described with respect to a preferred embodiment, modifications thereto will be apparent to those skilled in the art. Therefore, the scope of the invention is to be determined by reference to the claims which follow.

I claim:

1. A pavement remover for removing pavement with reinforcing rod comprising:

a frame;

a first set of drive tracks coupled to said frame;

a main conveyor connected to said frame;

a wedge coupled to said frame and adapted to wedge under said pavement upon a forward movement of said pavement remover;

a rotor having a longitudinal centerline about which said rotor is rotatably coupled to said frame;

an anvil coupled to said frame and being repositionably spaced apart from said longitudinal centerline so that the location of said longitudinal centerline relative to said anvil is adjustable;

a ramp situated between said wedge and said rotor and adapted to convey said pavement with reinforcing rod toward said rotor upon said first set of drive tracks driving said pavement remover in a forward direction; and a plurality of hammers 360 degrees rotatably mounted about themselves to said rotor at a location spaced apart from said longitudinal centerline such that said plurality of hammers are free to alternately swing away from and toward said longitudinal centerline, said plurality of hammers being adapted to strike and break up both said pavement and reinforcing rod overhanging said anvil such that both said pavement and reinforcing rod struck by said plurality of hammers is directed onto said main conveyor.

2. The pavement remover of claim 1 further comprising a plow situated between said wedge and said first set of drive tracks.

3. The pavement remover of claim 1 further comprising a plurality of side segments adjacent to said wedge, said side segments being selectively removable to match the width of said pavement.

4. The pavement remover of claim 1 wherein said pavement remover is adapted to provide a ground speed to rotor rpm ratio of 0.25 to 2 in/rev.

5. The pavement remover of claim 5, wherein said ground speed to rotor rpm ratio is 0.48 to 1.6 in/rev.

6. The pavement remover of claim 1 wherein said first set of drive tracks is rotatably coupled to said frame about a substantially vertical axis to render said pavement remover steerable.

7. The pavement remover of claim 1 further comprising a bolted together joint running lengthwise along said frame, rendering said frame separable into a left half frame and a right half frame.

8. The pavement remover of claim 1 wherein said anvil includes a plurality of indexable edges across which said pavement is intended to be sheared under tension upon impact of said plurality of hammers, said anvil with said plurality of indexable edges being repositionable relative to said rotor by way of a shim adjacent said anvil.

9. The pavement remover of claim 1 wherein said rotor is repositionably connected to said frame, whereby the location of said longitudinal centerline relative to said frame is variable.

10. The pavement remover of claim 1, further comprising a secondary frame resiliently coupled to said frame by way of an isolation mount, said secondary frame serving to couple said rotor to said frame.

11. The pavement remover of claim 10, wherein said isolation mount includes a spring.

12. A pavement remover for removing pavement with reinforcing rod, comprising:

a frame;

a first set of drive tracks coupled to said frame and adapted to propel said frame at a ground speed;

a second set of drive tracks coupled to said frame;

a main, conveyor connected to said a second conveyor in a position to receive a discharge from said main conveyor;

a wedge pivotally coupled to said frame and adapted to wedge under said pavement upon a forward movement of said pavement remover;

a rotor having a longitudinal centerline about which said rotor is rotatably connected to said frame, said rotor being repositionably connected to said frame by way of a plurality of shims, whereby the location of said longitudinal centerline relative to said frame is variable:

a ramp situated between said wedge and said rotor and adapted to convey said pavement with reinforcing rod toward said rotor upon said first set of drive tracks driving said pavement remover in a forward direction; and a plurality of hammers rotatably mounted about themselves to said rotor at a location spaced apart from said longitudinal centerline such that said plurality of hammers are free to alternately swing away from and toward said longitudinal centerline, said plurality of hammers being adapted to strike and break up both said pavement and reinforcing rod such that both said pavement and reinforcing rod struck by said plurality of hammers is directed onto said main conveyor, said pavement remover being adapted to provide a ground speed to rotor rpm ratio of 0.25 to 2 in/rev.

13. The pavement remover of claim 12 further comprising a bolted-together joint running lengthwise along said frame, rendering said frame separable into a left frame and a right half frame.

* * * * *